US005782044A

United States Patent [19]

Dodd et al.

[11] Patent Number: 5,782,044

[45] Date of Patent: Jul. 21, 1998

[54] MULTI-TREAD ENTRY GRID

[75] Inventors: Ronald N. Dodd; James J. Hopper, II; Johnnie D. Hilburn, Jr., all of Wichita, Kans.

[73] Assignee: Balco Metalines Inc., Wichita, Kans.

[21] Appl. No.: 873,821

[22] Filed: Jun. 12, 1997

[51] Int. Cl.[6] ..... E04F 11/16; E04F 15/02

[52] U.S. Cl. ..... 52/177; 52/181; 52/536; 52/539; 52/542; 52/592.1

[58] Field of Search ..... 52/177, 181, 536, 52/539, 542, 592.1

[56] References Cited

U.S. PATENT DOCUMENTS

| | | | |
|---|---|---|---|
| 3,555,762 | 1/1971 | Costanzo, Jr. | 52/177 X |
| 5,054,253 | 10/1991 | Bedics | 52/177 |
| 5,185,193 | 2/1993 | Phenicie et al. | 52/536 X |
| 5,215,802 | 6/1993 | Sijpesteijn | 52/177 X |
| 5,513,472 | 5/1996 | Olsen et al. | 52/177 |

OTHER PUBLICATIONS

C/S Group, C/S Entrance Mat Systems, 1997, pp. 14–15.

*Primary Examiner*—Christopher Kent
*Attorney, Agent, or Firm*—Hovey, Williams, Timmons & Collins

[57] ABSTRACT

A preferred foot traffic grid has a plurality of grid sections including an initial grid section, a terminating grid section, and a plurality of intermediate grid sections therebetween. Adjacent grid sections are coupled using a pair of spaced connectors received in corresponding channels in the adjacent connector. The channels and connectors are positioned on opposed sides of a support leg.

25 Claims, 2 Drawing Sheets

MULTI-TREAD ENTRY GRID

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention is concerned with the field of foot traffic entry grids. In particular, the invention is concerned with a preferred grid having a plurality of grid sections including an initial grid section, a terminating grid section, and a plurality of intermediate grid sections therebetween. Adjacent grid sections are coupled using a pair of spaced connectors received in corresponding channels in the adjacent connector with the channels and connectors positioned on opposed sides of a support leg.

2. Description of the Prior Art

The prior art discloses various types of entry grids. These prior art entry grids tend to be mechanically complex, expensive to manufacture, or present structural weakness.

SUMMARY OF THE INVENTION

The present invention solves the prior art problems mentioned above and presents a distinct advance in the state of the art. More particularly, the foot traffic grid hereof is mechanically simple leading to economy of manufacture and designed for structural strength for a long-lasting installation.

The preferred foot traffic grid has a plurality of grid sections including an initial grid section, a terminating grid section and a plurality of intermediate grid sections. Adjacent grid sections are coupled by a pair of spaced, dependent connectors received in corresponding channels defined in an adjacent connector with the channels and connectors spaced on opposed sides of a support leg.

The preferred grid sections include tread retainer clips defining tread channels for receiving and holding tread inserts, and include drain troughs between adjacent tread channels with holes in the bottom walls of the troughs for draining debris and moisture. The preferred embodiment also includes a plurality of different types of intermediate grids configured to receive a different number of tread inserts. This allows a selection of intermediate grid sections as necessary to span the width of an entryway. Other preferred aspects of the present invention are disclosed herein.

DETAILED DESCRIPTION OF THE PREFERRED EMBODIMENT

Figure 1:
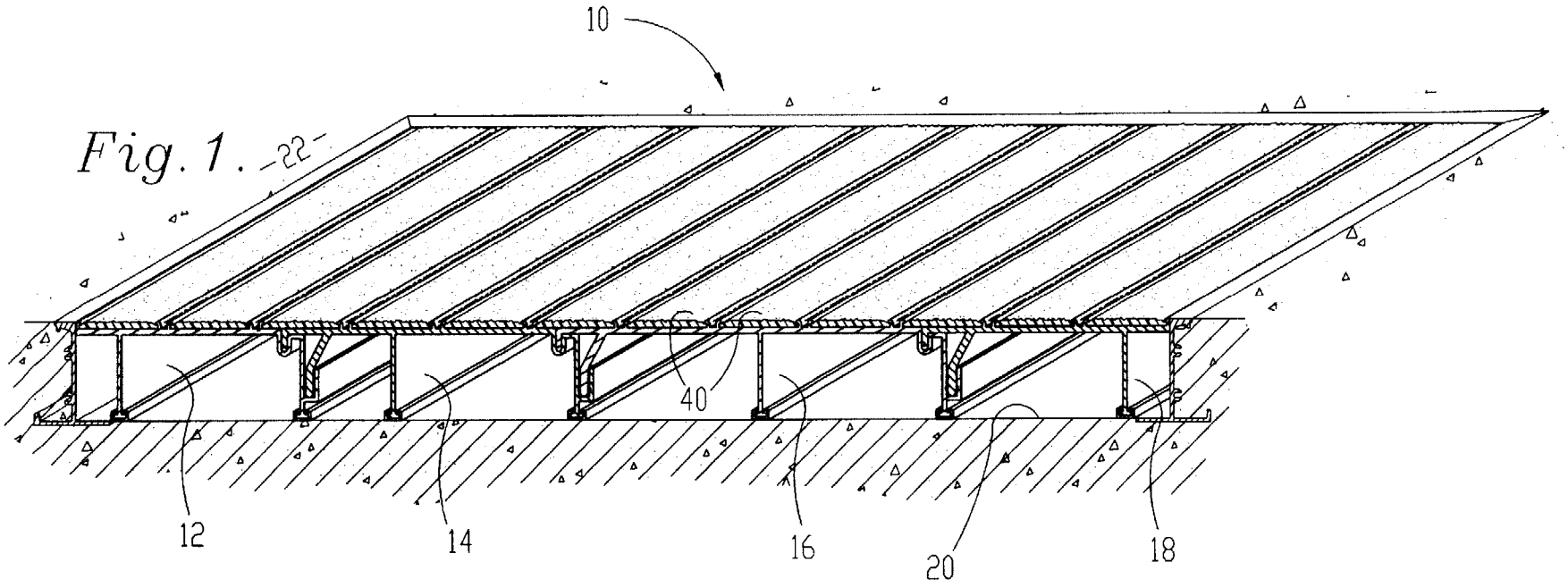
FIG. 1 is a pictorial view in partial section illustrating the preferred foot traffic grid in accordance with the present invention.
Figures 2, 3, 4, 5, 6:
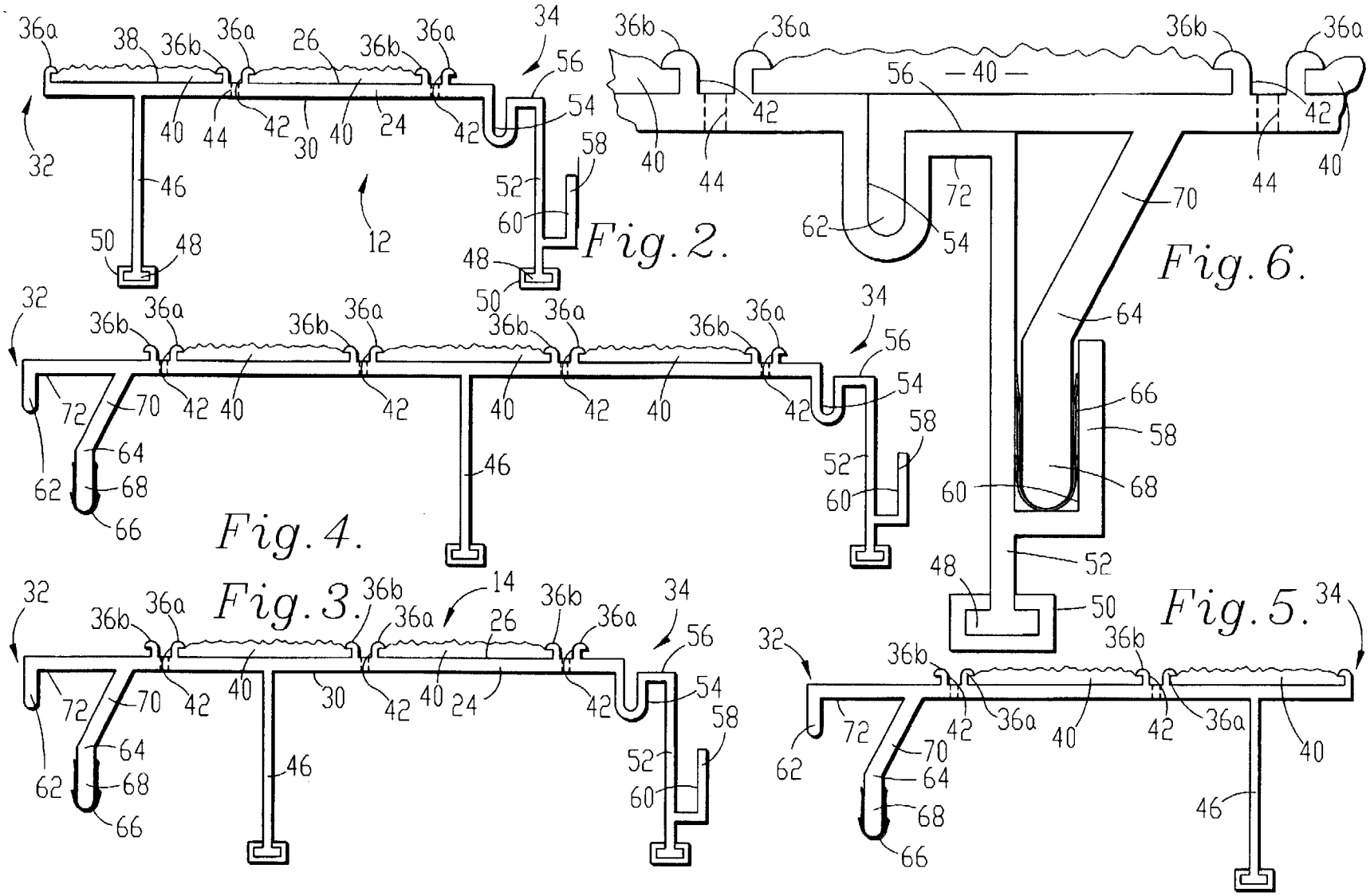
FIG. 2 is an end elevational view of the preferred initial grid section of FIG. 1.
FIG. 3 is an end elevational view of an intermediate grid section of FIG. 1 for supporting four tread inserts.
FIG. 4 is an end elevational view of an intermediate grid section of FIG. 1 for supporting five grid inserts.
FIG. 5 is an end elevational view of the terminating grid section of FIG. 1.
FIG. 6 is a partial end elevational view illustrating coupling between adjacent grid sections of FIG. 1.

The drawing figures illustrate the preferred foot traffic grid apparatus of the present invention. As shown in FIG. 1 and the other figures, apparatus 10 includes initial grid section 12 (FIG. 2), intermediate grid section 14 (FIG. 3), intermediate grid section 16 (FIG. 4), and terminating grid section 18 (FIG. 5) with adjacent sections coupled as illustrated in FIG. 6. FIG. 1 illustrates apparatus in a typical installation received in recess 20 adjacent walkway surface 22 with the tread surface of apparatus 10 substantially even, that is, flush with walkway surface 22.

Referring to FIG. 2 and the viewpoint thereof, initial grid section 12 includes support body 24 presenting planar upper surface 26, planar lower surface 28, left side 30 and right side 32. Support body 20 also includes a plurality of pairs 36 of tread clips with each mated pair including left clip **36*a* and right clip 36*b* defining tread channel 38 therebetween with a conventional tread insert 40** received therein.

As shown, initial grid section 12 includes two pairs of tread clips 36 for securing two tread inserts 40, and an additional left clip **36*a* for securing the left side of a third tread insert that overlaps the adjacent grid section. Thus, initial grid section 12 presents a width sufficient for two and a half treads. Also, the leftmost clip 36*a* is coincident with left side 32 to provide an abutting surface for engaging the side wall of recess 20. Support body 24 along with adjacent tread clips 36*a,b*, that are not mated pairs, define drain channels 42. Drain holes 44 are spaced along the length of channel 42 through support body 24 in order to drain debris and moisture into recess 20**.

Support leg 46 extends downwardly from support body 24 adjacent left side 32 and positioned midway under leftmost tread insert 40. Support leg 46 includes support foot 48 as a cross member at the lower end of leg 46 with foot 48 enclosed in a synthetic resin elastomer 50 for cushioned support of initial grid section 12. Support leg 52 is positioned adjacent right side 34 and also presents a support foot 48 enclosed in elastomer 50.

Support body 24 is configured as illustrated to define connector-receiving inboard channel 54 and to present contact surface 56 positioned between channel 54 and the upper end of support leg 52. L-shaped channel structure 58 extends from support leg 52 on the outboard side thereof and cooperates therewith to define outboard connector-receiving channel 60 positioned near the lower end of support leg 46 and below the level of inboard channel 54. With this configuration, channels 54, 60 are spaced on opposed sides of support leg 52. Channels 54, 60 are used to couple initial grid section 12 with an adjacent grid section which can be either an intermediate grid section or a terminating grid section.

FIG. 3 illustrates intermediate grid section 14 and includes some components structurally similar to those of initial grid section 12 and are numbered the same. These include components 24–60. In addition, intermediate grid section 14 includes connectors 62 and 64 along with timmerman clip 66 coupled with the lower end of connector 64. As shown, connector 62 extends downwardly from support body 24 from left side 32 thereof and is configured to mate with inboard channel 54 as shown in FIG. 6.

Connector 64 includes connector portion 68 and brace portion 70 extending between support body 24 and connector portion 68 at an acute angle. This configuration facilitates coupling adjacent sections and also provides a wider base of structural support.

Also as illustrated, intermediate grid section 14 is configured to support two tread inserts 40 plus half of another insert adjacent right side 34 and another half of an insert adjacent left side 32 extending over connectors 62, 64. Lower surface 30 presents contact area 72 adjacent connector 62 for engaging contact surface 56 when adjacent sections are coupled.

FIG. 6 illustrates adjacent, coupled grid sections. Connector 62 is received in channel 54 and connector 64 is received in channel 54 with clip 66 retaining connector portion 68 therein. Additionally, contact area 72 is in contact with contact surface 56. This configuration provides substantial structural strength to apparatus 10. Connectors 62, 64 are spaced and supported on opposed sides of support leg 52 which increases the structural support provided by leg 52. Contact surface 56 provides additional support to the support body 24 of an adjacent grid, and the angular arrangement of brace portion 70 widens the support base for support body 24.

FIG. 6 also illustrates that the upper surfaces 26 of adjacent grid sections are positioned adjacent one another and at the same level thereof to provide a contiguous support surface throughout the area of apparatus 10. A tread insert 40 covers the joint between adjacent grid sections.

FIG. 4 illustrates intermediate grid section 16 which is the same as grid section 12 except for the additional width to include an additional tread insert 40. With two varieties of intermediate widths available, designers are provided with greater flexibility when designing a foot traffic grid.

Terminating grid section 18 is illustrated in FIG. 5 and includes components similar to grid sections 12 and 14 with similar components numbered the same. More particularly, terminating grid section 18 includes connectors 62, 64 on left side 32 thereof, but does not include channels 54, 60 because section 18 is designed to abut the side wall of recess 20. Additionally, terminating grid section 18 includes only one support leg 46 and is configured to support two and a half tread inserts 40. Grid sections 12–18 are preferably formed of extruded aluminum (except for tread inserts 40, elastomers 50 and clips 66) to present an integral construction.

From the description above, those skilled in the art will now appreciate that apparatus 10 presents a walkway grid that is economical to manufacture because of its structural simplicity while presenting a distinct improvement in structural strength and durability. It will also be appreciated that the present invention encompasses many variations in the preferred embodiment described above. Having thus described the preferred embodiment of the present invention, the following is claimed as new and desired to be secured by Letters Patent:

What is claimed is:

1. A foot traffic grid apparatus comprising:

a first grid section including a first support body having a first upper surface, an opposed first lower surface, a first side and an opposed second side a support leg extending downwardly from said first support body adjacent said first side, there being channel means defining first and second, upwardly opening, spaced, connector-receiving channels positioned on opposed sides of said support leg; and a second grid section including a second support body having a second upper surface, an opposed second lower surface, a first side and a second side, and first and second, spaced connectors extending downwardly from said second support body adjacent said first side thereof, said first and second connectors being configured for reception in said first and second channels respectively on opposed sides of said support leg for positioning said second support surface adjacent to and on the same level as said first support surface each of said grid sections including tread channel means defining at least one tread channel for receiving and holding a tread.

2. The apparatus as set forth in claim 1, said first channel being positioned between said first support surface and said support leg with a contact surface therebetween below the level of said first upper surface.

3. The apparatus as set forth in claim 2, said first connector extending downwardly adjacent said second lower surface, said second lower surface presenting a contact area adjacent said first connector configured for contacting said second contact surface.

4. The apparatus as set forth in claim 1 further including a tread received in said tread channel.

5. The apparatus as set forth in claim 4, each of said grids including a plurality of said tread channels with respective drain troughs defined therebetween.

6. The apparatus as set forth in claim 5 further including means defining drain holes in said drain troughs extending through said support bodies.

7. The apparatus as set forth in claim 1, said tread channel means including a pair of spaced tread clips.

8. The apparatus as set forth in claim 1, said second grid section including connector-receiving channels and a support leg adjacent said second side thereof configured the same as said first and second channels and support leg of said first grid section.

9. The apparatus as set forth in claim 8, said first grid section being devoid of connector-receiving channels and connectors on said second side thereof in order to form an initial grid section, said second grid being an intermediate grid section, said apparatus further including a third grid section presenting opposed first and second sides and having connectors configured the same as said first and second connectors and for reception in said connector-receiving channels of said second grid section, said third grid section being devoid of connector-receiving channels and connectors on said second side thereof in order to form a terminating grid section.

10. The apparatus as set forth in claim 9 including only one initial grid section and only one terminating grid section.

11. The apparatus as set forth in claim 10 including a plurality of said intermediate grid sections.

12. The apparatus as set forth in claim 1 further including a clip between at least one of said connectors and channels.

13. A foot traffic grid apparatus comprising:

a first grid section including a first support body having a first upper surface, an opposed first lower surface, a first side and an opposed second side a support leg extending downwardly from said first support body adjacent said first side, there being channel means defining first and second, upwardly opening, spaced, connector-receiving channels positioned on opposed sides of said support leg; and a second grid section including a second support body having a second upper surface, an opposed second lower surface, a first side and a second side, and first and second, spaced connectors extending downwardly from said second support body adjacent said first side thereof, said first and second connectors being configured for reception in said first and second channels respectively on opposed sides of said support leg for positioning said second support surface adjacent to and on the same level as said first support surface said channel means including structure coupled with said support leg on the outboard side thereof and cooperating therewith to define said second channel below the level of said first channel, said second connector including an extension portion extending at an acute angle relative to said support leg.

14. The apparatus as set forth in claim 13, said first channel being positioned between said first support surface and said support leg with a contact surface therebetween below the level of said first upper surface.

15. The apparatus as set forth in claim 14, said first connector extending downwardly adjacent said second lower surface, said second lower surface presenting a contact area adjacent said first connector configured for contacting said second contact surface.

16. The apparatus as set forth in claim 13, each of said grid sections including tread channel means defining at least one tread channel for receiving and holding a tread.

17. The apparatus as set forth in claim 16 further including a tread received in said tread channel.

18. The apparatus as set forth in claim 17, each of said grids including a plurality of said tread channels with respective drain troughs defined therebetween.

19. The apparatus as set forth in claim 18 further including means defining drain holes in said drain troughs extending through said support bodies.

20. The apparatus as set forth in claim 14, said tread channel means including a pair of spaced tread clips.

21. The apparatus as set forth in claim 17, said second grid section including connector-receiving channels and a support leg adjacent said second side thereof configured the same as said first and second channels and support leg of said first grid section.

22. The apparatus as set forth in claim 21, said first grid section being devoid of connector-receiving channels and connectors on said second side thereof in order to form an initial grid section, said second grid being an intermediate grid section, said apparatus further including a third grid section presenting opposed first and second sides and having connectors configured the same as said first and second connectors and for reception in said connector-receiving channels of said second grid section, said third grid section being devoid of connector-receiving channels and connectors on said second side thereof in order to form a terminating grid section.

23. The apparatus as set forth in claim 22 including only one initial grid section and only one terminating grid section.

24. The apparatus as set forth in claim 23 including a plurality of said intermediate grid sections.

25. The apparatus as set forth in claim 13 further including a clip between at least one of said connectors and channels.

* * * * *